US006324960B1

(12) United States Patent
Enokijima et al.

(10) Patent No.: US 6,324,960 B1
(45) Date of Patent: Dec. 4, 2001

(54) PISTON FOR SWASH PLATE TYPE COMPRESSOR, INCLUDING HEAD PORTION HAVING LUBRICANT RESERVOIR RECESS, AND METHOD OF FORMING THE RECESS

(75) Inventors: Fuminobu Enokijima; Takahiro Hoshida, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/594,293

(22) Filed: Jun. 15, 2000

(30) Foreign Application Priority Data

Jun. 15, 1999 (JP) ..... 11-168591
Jun. 30, 1999 (JP) ..... 11-185638

(51) Int. Cl.[7] ..... F01B 3/00; F01B 31/10
(52) U.S. Cl. ..... 92/71; 92/186; 92/159
(58) Field of Search ..... 92/71, 186, 159, 92/160

(56) References Cited

U.S. PATENT DOCUMENTS 5,382,139 1/1995 Kawaguchi et al. ..... 417/269
5,868,556 * 2/1999 Umemura ..... 417/269
5,941,161 8/1999 Kimura et al. ..... 92/155
6,024,009 2/2000 Morita et al. ..... 92/12.2

FOREIGN PATENT DOCUMENTS 0 809 025 A1 11/1997 (EP) ..... F04B/27/08
0 857 530 A1 8/1998 (EP) ..... B23B/5/40
0 945 615 A2 9/1999 (EP) ..... F04B/27/08
6-336977 12/1994 (JP) ..... F04B/27/08
7-189900 7/1995 (JP) .
9-105380 4/1997 (JP) .
9-203378 8/1997 (JP) .

* cited by examiner

*Primary Examiner*—F. Daniel Lopez
*Assistant Examiner*—Michael Leslie
(74) *Attorney, Agent, or Firm*—Morgan & Finnegan, LLP

(57) ABSTRACT

A piston for a swash plate type compressor, including a head portion slidably fitted in a cylinder bore formed in a cylinder block of the compressor, a neck portion slidably engaging a swash plate of the compressor, and a connecting portion connecting the head and neck portions, wherein the head portion has an inner surface which faces towards a centerline of the piston and which has at least one recess formed therein. Each recess is configured so as to accommodate a liquid when the piston is fitted in the cylinder bore.

16 Claims, 14 Drawing Sheets

PISTON FOR SWASH PLATE TYPE COMPRESSOR, INCLUDING HEAD PORTION HAVING LUBRICANT RESERVOIR RECESS, AND METHOD OF FORMING THE RECESS

This application is based on Japanese Patent Application Nos. 11-168591 and 11-185638 filed Jun. 15 and Jun. 30, 1999, respectively, the contents of which are incorporated hereinto by reference.

BACKGROUND OF THE INVENTION

1. Field of the Invention

The present invention relates to a piston used for a swash plate type compressor.

2. Discussion of the Related Art

As a piston for a swash plate type compressor, there are known various types of pistons each of which has (a) a head portion which is slidably fitted in a cylinder bore formed in a cylinder block, (b) a neck portion which engages a swash plate, and (c) a connecting portion which connects the head portion and the neck portion. An example of such pistons is disclosed in JP-A-9-203378. In the swash plate type compressor piston disclosed in this publication, the head portion has a through-hole formed therethrough in a direction substantially parallel to the circumferential direction of the cylinder block. The surfaces of this through-hole which face in a direction intersecting the centerline of the piston are substantially flat or convexed towards the centerline, for easy removal of the piston from a casting mold or a forging die after the piston is formed by casting or forging.

Usually, the swash plate type compressor is lubricated by a lubricant oil in a liquid or mist phase contained or dispersed in a refrigerant gas or other gas to be compressed. The lubricant oil is delivered together with the gas into the crank chamber, for lubricating the contacting surfaces of the swash plate and the shoes, the contacting surfaces of the shoes and the pistons, and the contacting surfaces of the pistons and the cylinder bores. In some cases, the lubricant oil separated from the gas by a separator is delivered in a liquid state into the crank chamber through a rotary drive shaft by which the swash plate is rotated. This lubricant is splashed within the crank chamber and is eventually turned into a mist state. The known swash plate type compressor tend to suffer from a shortage of the lubricant oil, and an accordingly low degree of slidability of the swash plate, shoes, pistons and cylinder bore. In particular, the cylinder bores located at relatively high positions in the cylinder block and the pistons fitted therein are likely to suffer from insufficient lubrication and relatively low slidability. Since the specific gravity of the lubricant is larger than that of the gas to be compressed, the lubricant is sufficiently delivered to the cylinder bores and pistons located at relatively low positions in the cylinder block, and to the corresponding shoes. However, the lubricant oil is less likely to be sufficiently delivered to the cylinder bores, pistons and shoes which are located at the relatively high positions.

SUMMARY OF THE INVENTION

It is an object of the present invention to improve the slidability of a piston used for a swash plate type compressor. This object may be achieved by a piston for a swash plate type compressor, which is constructed according to any one of the following forms or modes of the present invention, each of which is numbered like the appended claims and depends from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A piston for a swash plate type compressor, including a head portion slidably fitted in a cylinder bore formed in a cylinder block of the compressor, a neck portion slidably engaging a swash plate of the compressor, and a connecting portion connecting the head and neck portions, wherein the head portion has an inner surface which faces towards a centerline of the piston and which has at least one recess formed therein, the inner surface being located and the at least one recess being configured such that the at least one recess can accommodate a liquid when the piston is fitted in the cylinder bore.

The piston for a swash plate type compressor, which is constructed according to the above form (1) of this invention, has one or more recesses capable of accommodating a liquid when the piston is fitted in the corresponding cylinder bore. In this arrangement, a lubricant oil dispersed in a mist state within the crank chamber of the compressor is accumulated or accommodated in the at least one recess, and is splashed by a reciprocating movement of the piston, so that the lubricant is delivered between the cylinder bore and the piston, and between the swash plate and the piston, more specifically, between the swash plate and the shoes, and between the shoes and the piston. Accordingly, the contacting surfaces of the cylinder bore and the piston and the contacting surfaces between the swash plate and the piston can be sufficiently lubricated, assuring a smooth operation of the swash plate type compressor.

When the swash plate type compressor is not in operation, that is, when the piston is placed in a non-operated state, the lubricant oil which has been dispersed or suspended during operation of the compressor is settled and accumulated in the at least one recess. When the operation of the swash plate type compressor is initiated, that is, when the reciprocating movement of the piston is initiated, the lubricant oil accumulated in the at least one recess is splashed out to be supplied in between the piston and the swash plate and between the piston and the cylinder bore, for effectively lubricating their contacting surfaces. The lubricant oil is accumulated in the at least one recess also while the piston is reciprocated. That is, the lubricant oil is splashed out of the at least one recess while at the same time the oil is accumulated in the at least one recess, so that the at least one recess functions to deliver the lubricant oil even while the compressor is in operation. Thus, the compressor can be held in a fully lubricated condition throughout the operation of the compressor. The improved slidability of the piston is effective to prevent a local wear or removal of the coating on the outer circumferential surface of the piston, advantageously resulting in a prolonged service life of the piston. In addition, the provision of the at least one recess is effective to reduce the weight of the piston.

Usually, the swash plate type compressor is installed such that the axis of rotation of the rotary drive shaft, namely, the centerline of the cylinder block extends in the horizontal direction. In some cases, the centerline of the cylinder block is not completely parallel to the horizontal direction, and is more or less inclined with respect to the horizontal plane, depending upon the environment in which the compressor is installed. However, the compressor is usually installed with its centerline held substantially horizontal. In this usual orientation of the compressor, a plurality of cylinder bores are arranged along a circle whose center lies on the centerline of the cylinder block, such that the cylinder bores extend in parallel with the centerline of the cylinder block. The piston is slidably fitted in each cylinder bore. The angular phase of each piston about the centerline of the cylinder block is determined by the angular position or vertical position of the corresponding cylinder bore. The piston fitted in the cylinder bore at a relatively high position in the cylinder block has an angular phase in which the neck portion is open in the downward direction for engagement with the swash plate, while the piston fitted in the cylinder bore at a relatively low position has an angular phase in which the neck portion is open in the upward direction for engagement with the swash plate. Thus, the pistons fitted in the respective cylinder bores have respective different angular phases wherein the radial directions in which the neck portions are open towards the centerline of the cylinder block are different from each other by a predetermined angle which is determined by the number of the cylinder bores (pistons).

Therefore, the at least one recess of the piston is not capable of accommodating the liquid irrespective of the angular phase of the piston, or irrespective of the vertical position of the cylinder bore. in which the piston is fitted. Namely, the at least one recess of the piston may not be capable of accommodating the liquid when the piston has a certain angular phase. In other words, the at least one recess is not capable of accommodating the liquid in all of the pistons fitted in the cylinder bores.

The at least one recess may be configured so as to accommodate the liquid irrespective of the angular phase of the piston, that is, in all of the pistons. For example, the at least one recess may be formed to deal with the angular phases of all of the pistons. However, this arrangement is not essential. According to the present invention, the at least one recess is formed in each piston so that the at least one recess can accommodate the liquid in at least one of the pistons fitted in the cylinder bores, that is, for at least one of the different angular phases of the pistons, because the lubricating condition of the compressor as a whole can be improved as compared with that in the conventional compressor wherein no recesses are provided.

In the above case, the positions and the number of the pistons in which the lubricant oil can be accommodated in the at least one recess are determined by the configuration of each recess. In the example of FIG. 6 in which the piston fitted in the cylinder bore is rotated about the centerline N by an angle θ with respect to the vertical plane, the recess has a portion which is located below an imaginary horizontal plane P which is parallel to a horizontal plane passing the centerline N. In this case, the liquid can be accommodated in the above-indicated portion of the recess. That is, if the entire peripheral edge of the above-indicated portion of the recess is closer to the centerline N than the bottom of the recess when the piston is oriented in its angular phase, the liquid can be accommodated in the liquid. However, it is desirable to form the recess so that the liquid can be accommodated in the recess when the piston is fitted in the cylinder bore located at a relatively high position in the cylinder block 10. In this respect, it is noted that the lubricant oil tends to be insufficient between the piston and the cylinder bore and swash plate, particularly where the piston is located at the relatively high position in the cylinder block, as described above.

The piston may have a single recess, or two or more recesses. Where the two or more recesses are formed, it is desirable that the two or more recesses are formed in respective different inner surfaces of the head portion which face towards the centerline and in different directions intersecting the centerline at different angles, rather than in one inner surface of the head portion. This desired arrangement permits a larger number of the pistons (having different angular phases) in which the liquid can be accommodated in at least one of the recesses, so that the lubricating conditions of the pistons adjacent to those pistons can also be improved, whereby the lubricating condition of the swash plate type compressor as a whole can be improved. Each recess provided according to the present invention may be considered to be a lubricant reservoir in which the liquid in the form of the lubricant oil is accommodated.

(2) A piston for a swash plate type compressor, including a head portion slidably fitted in a cylinder bore formed in a cylinder block of the compressor, a neck portion slidably engaging a swash plate of the compressor, and a connecting portion connecting the head and neck portions, wherein the head portion has an inner surface which faces towards a centerline of the piston and which has at least one recess formed therein, each of the at least one recess having a cross sectional profile in a cross sectional plane substantially parallel to a center plane which includes the centerline of the piston and a centerline of the cylinder block, the cross sectional profile including an arc of a circle whose center lies on a straight line perpendicular to the cross sectional plane, the arc extending from a first point on the circle at which a central angle is not larger than 90° to a second point on the circle at which the central angle is larger than 90°, the central angle being measured with respect to a reference plane which includes the center of the circle and which is parallel to the centerline of the piston and perpendicular to the center plane.

In the swash plate type piston constructed according to the above form (2) of this invention, the cross sectional profile of each recess formed in the inner surface is determined so as to enable each recess to accommodate the liquid. As described below in detail by reference to FIGS. 18–21 in the DETAILED DESCRIPTION OF THE PREFERRED EMBODIMENTS, the cross section profile is significant in that where the center plane is vertical, the lowest point on the bottom surface of the recess is located at the position at which the central angle with respect to the reference plane is 90°. The cross sectional profile includes the arc extending from the point at which the central angle is not larger than 90° to the point at which the central angle is larger than 90°. In this arrangement, the recess can include a portion the entire peripheral edge of which is higher than the lowest point, so that the liquid can be accommodated in this portion of the recess.

For example, each recess provided in the piston according to the above form (2) can be formed by a peripheral cutting edge of a cutting tool such as a side milling cutter, which is rotatable about an axis perpendicular to the cross sectional plane indicated above. For instance, the body of the cutting tool is first moved into an opening provided in the piston, while the axis of rotation of the cutting tool is held perpendicular to the center plane, and is then fed in a direction parallel to the center plane. For example, the cutting tool may be fed in the direction perpendicular to the centerline of the piston and parallel to the center plane. Alternatively, the cutting tool may be fed first in the direction parallel to the centerline of the piston from the neck portion towards the head portion, and is then fed in the direction perpendicular to the centerline of the piston and parallel to the center plane. The cutting tool may be fed in a direction inclined with respect to the centerline of the piston. If necessary, the cutting tool is fed in its axial direction, which is perpendicular to the center plane. Further, the axis of rotation of the cutting tool may be inclined a small angle with respect to the plane perpendicular to the center plane. In this case, the cutting tool may be fed in parallel with the plane perpendicular to the axial direction of the tool, or in parallel with the center plane. In this case, too, the cutting tool may be fed in its axial direction, or in the direction perpendicular to the center plane.

(3) A piston for a swash plate type compressor, including a head portion slidably fitted in a cylinder bore formed in a cylinder block of the compressor, a neck portion slidably engaging a swash plate of the compressor, and a connecting portion connecting the head and neck portions, wherein the head portion includes a body portion which is circular in cross section, and an outer sliding section and an inner sliding section which extend towards the neck portion from respective circumferential parts of the body portion which correspond to respective radially outer and inner portions of the cylinder block, the outer and inner sliding sections having respective sliding surfaces for sliding contact with respective circumferential portions of an inner circumferential surface of the cylinder bore, the outer sliding section having a first inner surface which faces towards the inner sliding section, the inner sliding section having a second inner surface which faces towards the outer sliding section, the body portion having a circular hole formed in an inner surface which faces towards the neck portion, the circular hole having a centerline alinged with the centerline of the piston, at least one of the first and second inner surfaces and an inner circumferential surface of the circular hole having at least one recess which is configured so as to accommodate a liquid when the piston is fitted in the cylinder bore.

If a recess is formed in the second inner surface of the inner sliding section, the liquid can be accommodated in the recess where the piston is fitted in the cylinder bore located at a relatively high position in the cylinder block. If a recess is formed in the first inner surface of the outer sliding section, the liquid can be accommodated in the recess where the piston is fitted in the cylinder bore located at a relatively low position in the cylinder block. If at least one recess is formed in the inner circumferential surface of the circular hole formed in the inner surface of the body portion which faces the neck portion (which is opposite to the outer surface partially defining the pressurizing chamber), each recess is formed to be open substantially upwards when the piston is fitted in the cylinder bore, so that the liquid can be accommodated in each recess. If an annular recess is formed in the inner circumferential surface of the circular hole over its entire circumference, the liquid can be accommodated in a circumferential portion of the annular recess which corresponds to the angular position or phase of the piston. If a plurality of mutually independent recesses are formed at respective circumferential portions of the inner circumferential surface of the circular hole, the liquid can be accommodated in one of the recesses which corresponds to the angular position or phase of the piston.

In the piston according to the above form (3) of the invention, there is provided an opening between the inner and outer sliding sections of the head portion. This opening facilitates the formation of the at least one recess. Where the recess described above with respect to the above form (2) is formed in the piston according to the above form (3), the cutting tool is first advanced in the direction towards the center plane indicated above, so that the body of the tool is located within the opening, and then, the body of the tool is fed in parallel with the center plane, in the directions towards the inner and outer sliding sections, to form the recess in at least one of the inner surfaces of the inner and outer sliding sections. Further, the body of the cutting tool may be fed towards the inner surface of the body portion, within the opening. In the present form (3) of the invention, a recess may be formed in the inner surface of the body portion, as well as in the inner surfaces of the inner and outer sliding sections which face towards the centerline of the piston and in respective directions intersecting the centerline of the piston.

Where the head portion of the piston includes only one of the inner and outer sliding sections, at least one recess is formed in the inner surface of that one sliding section which faces in a direction intersecting the centerline.

(4) A piston according to any one of the above forms (1)–(3), wherein the head portion includes a body portion having a circular shape in cross section, and an outer sliding section and an inner sliding section which extend towards the neck portion from respective circumferential parts of the body portion which correspond to respective radially outer and inner portions of the cylinder block, the outer and inner sliding sections having respective sliding surfaces for sliding contact with respective circumferential portions of an inner circumferential surface of the cylinder bore, at least one of the outer and inner sliding sections having at least one through-hole formed therethrough in a radial direction of the piston.

The at least one through-hole permits effectively supply of the lubricant from the at least one recess to the inner circumferential surface of the cylinder bore. Each through-hole may be formed in communication with the recess, or formed independently of the recess. Where the through-hole is formed in communication with the recess, it is desirable to form the through-hole such that the through-hole communicates with the recess, at a position above the lowest point on the bottom surface of the recess.

It is noted that a through-hole may be formed through the body portion in its radial direction such that the through-hole is open in the outer circumferential sliding surface of the body portion. However, this through-hole is not desirable, since it reduces the fluid tightness between the body portion and the cylinder bore.

(5) A piston according to any one of the above forms (1)–(4), wherein the connecting portion includes at least one of an inner connecting part connecting the head and neck portions on a radially inner side of the cylinder block, and an outer connecting part connecting the head and neck portions on a radially outer side of the cylinder block.

Where the connecting portion does not include both of the inner and outer connecting parts, that is, includes only one of the inner and outer connecting parts, the weight of the piston is effectively reduced.

(6) A piston according to any one of the above forms (1)–(5), wherein the head portion includes (a) a body portion having a circular shape in cross section, (b) an outer sliding section and an inner sliding section which extend towards the neck portion from respective circumferential parts of the body portion which correspond to respective radially outer and inner portions of the cylinder block, the outer and inner sliding sections having respective sliding surfaces for sliding contact with respective circumferential portions of an inner circumferential surface of the cylinder bore, and (c) a wall connecting the outer and inner sliding sections.

The wall functions to increase the strength of the piston. Where the piston does not include the wall, on the other hand, the at least one recess can be comparatively easily formed.

(7) A piston for a swash plate type compressor including a cylinder block having a horizontally extending centerline and a plurality of cylinder bores formed along a circle whose center lies on the horizontally extending centerline, the piston being reciprocably received in one of the plurality of cylinder bores and comprising:

a head portion slidably fitted in the one of the plurality of cylinder bores;

a neck portion slidably engaging a swash plate of the compressor; and a connecting portion connecting the head and neck portions to each other, and wherein the head portion has an inner surface which is substantially parallel to a horizontal plane including the centerline of the piston and which faces upwards, the inner surface having at least one recess each of which has a bottom located below an entire peripheral edge thereof as seen in a vertical direction.

(8) A swash plate type compressor comprising:

a cylinder block having a horizontally extending centerline and a plurality of cylinder bores arranged along a circle whose center lies on the centerline;

a rotary drive shaft having an axis aligned with the centerline of the circle;

a swash plate rotated by the drive shaft; and a plurality of single-headed pistons each of which includes a head portion slidably fitted in a corresponding one of the plurality of cylinder bores, and a neck portion slidably engaging the swash plate, the piston being reciprocated by rotation of the swash plate by the drive shaft, and wherein the head portion of at least one of the plurality of pistons has an inner surface which faces generally upwards and in a direction towards a centerline of the piston, the inner surface having at least one recess which is configured so as to accommodate a liquid.

The inner surface which faces generally upwards is preferably a horizontally extending surface, but may be inclined with respect to the horizontal plane, provided the angle of inclination permits the recess to accommodate the liquid. The piston according to the above mode (8) may includes any one of the technical features of the above forms (2)–(7) of the invention.

(9) A method of forming at least one recess in an inner surface of a head portion of a piston for a swash plate type compressor including a cylinder block having a cylinder bore in which the piston is slidably received, the piston including (a) a neck portion slidably engaging a swash plate of the compressor, (b) the piston including a body portion having a circular shape in cross section, and an outer sliding section and an inner sliding section which extend towards the neck portion from respective circumferential parts of the body portion which correspond to respective radially outer and inner portions of the cylinder block, the outer and inner sliding sections having respective sliding surfaces for sliding contact with respective circumferential portions of an inner circumferential surface of the cylinder bore, and (c) a connecting portion connecting the head and neck portions to each other, the inner surface facing towards a centerline of the piston, the method comprising the steps of:

preparing a cutting tool including a shank, and a cutting portion which has a larger diameter than the shank and which is fixed to one end of the shank, the cutting portion having a peripheral cutting edge; and moving the cutting portion of the cutting tool and the piston relative to each other, within an opening provided between the outer and inner sliding sections, in directions substantially parallel to a center plane including a centerline of the cylinder block and the centerline of the piston, while an axis of rotation of the cutting tool is held substantially perpendicular to the center plane, so that the at least one recess is formed in the inner surface of the head portion, by at least the peripheral cutting edge.

Where the head portion of the piston has an opening between the outer and inner sliding sections, the at least one recess can be easily formed by the cutting tool, since the opening permits an easy access of the cutting portion of the cutting tool to the inner surface in which the at least one recess is to be formed. The opening may be formed through the head portion, or a blind hole or holes. Preferably, the cutting portion has a side cutting edge in addition to the peripheral cutting edge.

The at least one recess described above with respect to the above form (2) of this invention can be formed, if the point on the periphery of the peripheral cutting edge, which is most distant from a plane including the centerline of the piston and perpendicular to the above-indicated center plane, is located in the outer profile of the piston (before formation of the at least one recess), while the at least one recess is formed by the cutting portion.

BRIEF DESCRIPTION OF THE DRAWINGS

The above and optional objects, features, advantages and technical and industrial significance of this invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Figure 1:
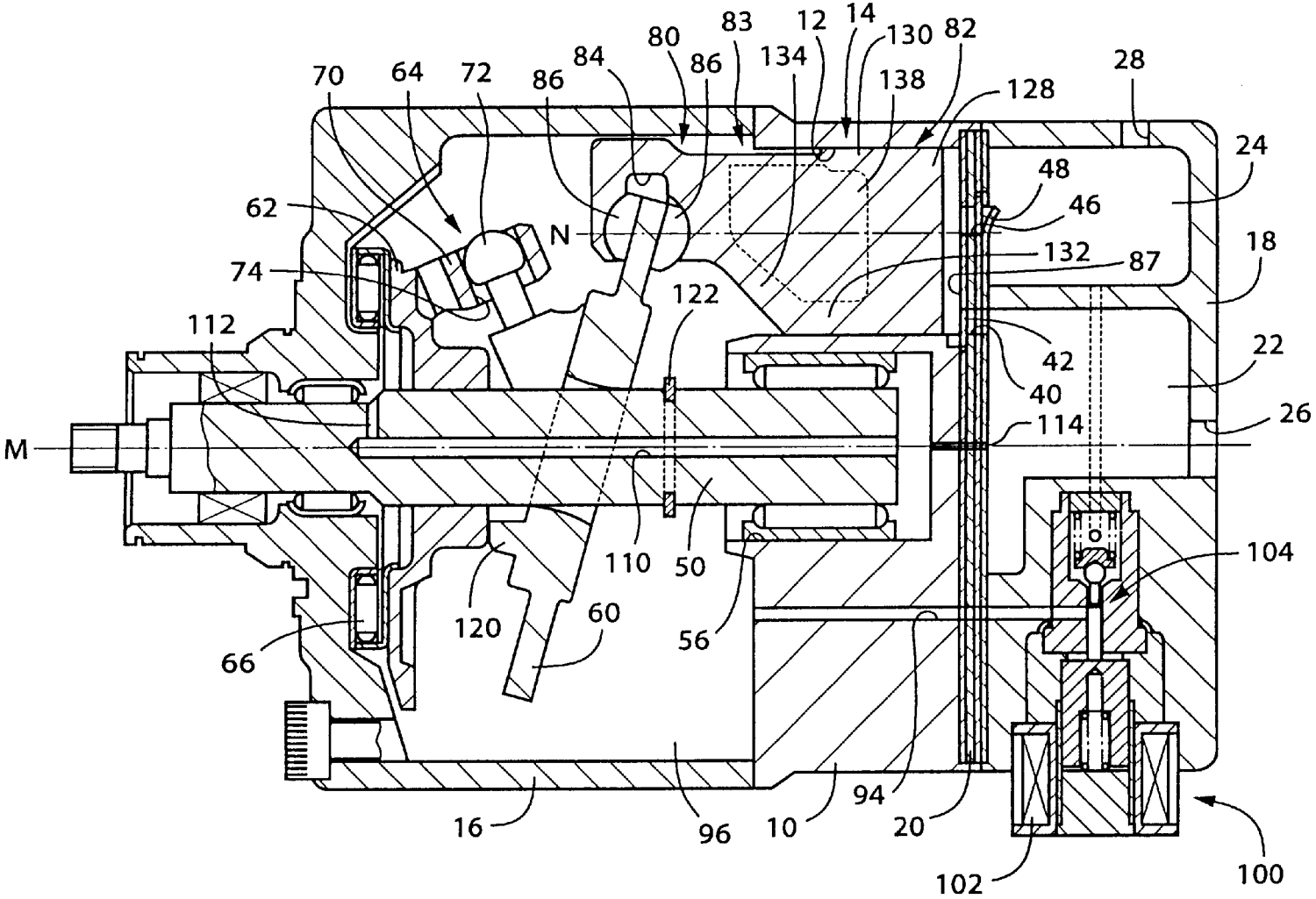
FIG. 1 is a front elevational view in cross section of a swash plate type compressor incorporating a piston constructed according to one embodiment of this invention.

Referring to FIGS. 1–10A, there will be described a piston for a swash plate type compressor, which is constructed according to the first embodiment of the present invention. FIG. 1 shows the swash plate type compressor incorporating a plurality of pistons.

In FIG. 1, reference numeral 10 denotes a cylinder block having a centerline M and a plurality of cylinder bores 12 formed so as to extend in its axial direction such that the cylinder bores are arranged along a circle whose center lies on the centerline M. The piston generally indicated at 14 is reciprocably received in each of the cylinder bores 12. To one of the axially opposite end faces (the left end face as seen in FIG. 1, which will be referred to as "front end face") of the cylinder block 10, there is attached a front housing 16. To the other end face (the right end face as seen in FIG. 1, which will be referred to as "rear end face"), there is attached a rear housing 18 through a valve plate structure 20. The front housing 16, rear housing 18 and cylinder block 10 cooperate to constitute a major portion of the body of the swash plate type compressor.

The rear housing 18 and the valve plate 20 cooperate to define a suction chamber 22 and a discharge chamber 24, which are connected to a refrigerating circuit (not shown) through an inlet 26 and an outlet 28, respectively. The valve plate structure 20 has suction ports 40, suction valves 42, discharge ports 46 and discharge valves 48.

A rotary drive shaft 50 is disposed in the cylinder block 10 and the front housing 16 such that the axis rotation of the drive shaft 50 is aligned with the centerline M of the cylinder block 10. The drive shaft 50 are supported at its opposite end portions by the front housing 16 and the cylinder block 10 via respective bearings. The cylinder block 10 has a central bearing hole 56 formed in a central portion thereof, and the bearing is disposed in this central bearing hole, for supporting the drive shaft 50 at its rear end portion.

The rotary drive shaft 50 carries a swash plate 60 mounted thereon such that the swash plate 60 is axially movable and tiltable relative to the drive shaft 50. To the drive shaft 50, there is fixed a lug plate 62 which is held in engagement with the swash plate 60 through a hinge mechanism 64. The lug plate 62 is rotatable with the drive shaft 50 relative to the front housing 16 through a thrust bearing 66. The hinge mechanism 64 causes the swash plate 60 to be rotated with the drive shaft 50 during rotation of the drive shaft 50, and guides the swash plate 60 for its axial and tilting motions.

The hinge mechanism 64 includes a pair of support arms 70 fixed to the lug plate 62, and guide pins 72 formed on the swash plate 60. The guide pins 72 slidably encage guide holes 74 formed in the support arms 70.

The piston 14 indicated above includes a neck portion 80 engaging the swash plate 60, a head portion 82 fitted in the corresponding cylinder bore 12, and a connecting portion 83 connecting the neck and head portions 80, 82. The neck portion 80 has a groove 84 formed therein, and the swash plate 60 is held in engagement with the groove 84 through a pair of hemi-spherical shoes 86. The hemi-spherical shoes 86 are held in the groove 84 at their hemi-spherical surfaces such that the shoes 86 slidably engage the neck portion 80 at their hemispherical surfaces, and slidably engage the opposite surfaces of the swash plate 60 at their flat surfaces. It will be understood that the piston 14 according to the present embodiment is a single-headed piston. The head portion 82 of the piston 14 cooperates with the cylinder block 10 and the valve plate structure 20 to define a pressurizing chamber 87. The configuration of the piston 14 will be described in detail.

A rotary motion of the swash plate 60 is converted into a reciprocating linear motion of the piston 14 through the shoes 86. A refrigerant gas in the suction chamber 22 is sucked or admitted into the pressurizing chamber 87 through the suction port 40 and the suction valve 42, when the piston 14 is moved from its upper dead point to its lower dead point, that is, when the piston 14 is in the suction stroke. The refrigerant gas in the pressurizing chamber 87 is pressurized by the piston 14 when the piston 14 is moved from its lower dead point to its upper dead point, that is, when the piston 14 is in the compression stroke. The thus pressurized refrigerant gas is delivered into the discharge chamber 24 through the discharge port 46 and the discharge valve 48. A reaction force acts on the piston 14 in the axial direction as a result of compression of the refrigerant gas in the pressurizing chamber 87. This compression reaction force is received by the front housing 16 through the piston 14, swash plate 60, lug plate 62 and the thrust bearing 66.

Figure 2:
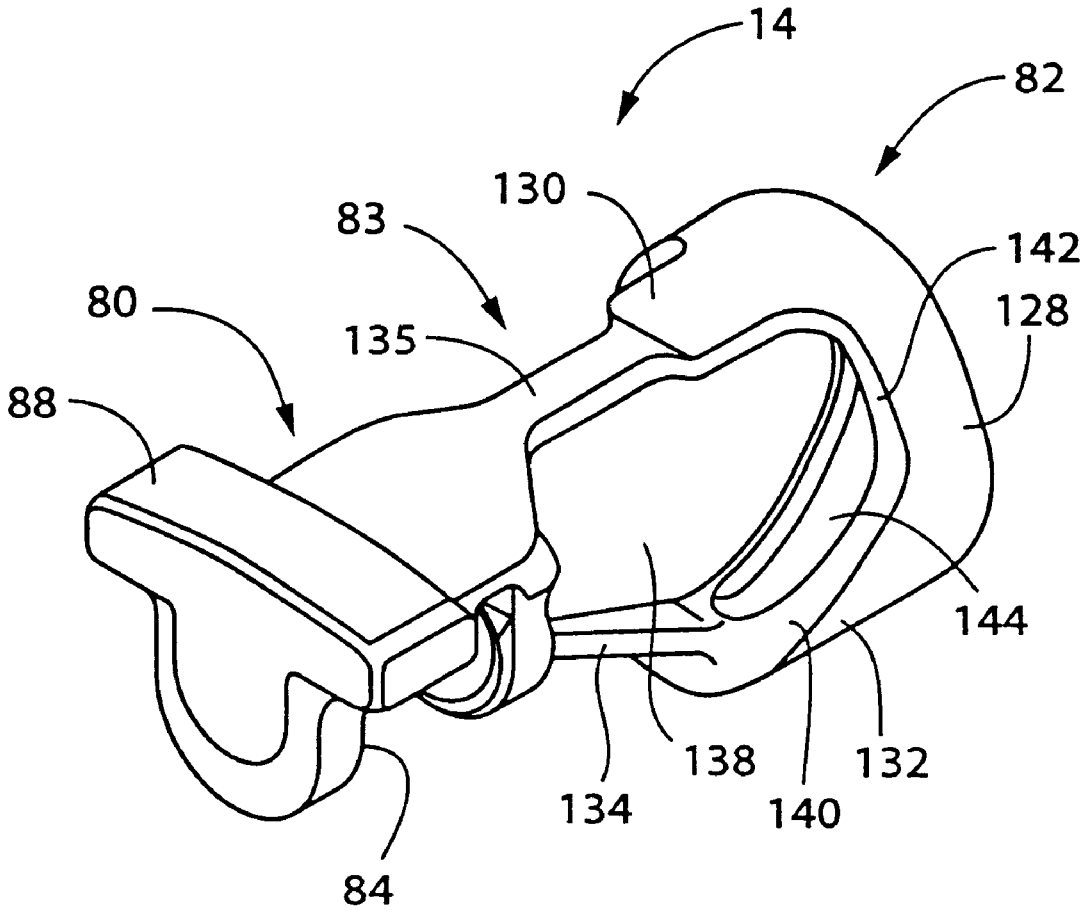
FIG. 2 is a perspective view showing the piston of FIG. 1 (having recesses formed therein)

As shown in FIG. 2, the neck portion 80 of the piston 14 has an integrally formed rotation preventive portion 88, which is arranged to contact the inner circumferential surface of the front housing 16, for thereby preventing a rotary motion of the piston 14 about its centerline N (FIG. 1).

The cylinder block 10 has an intake passage 94 formed therethrough for communication between the discharge chamber 24 and a crank chamber 96 which is defined between the front housing 16 and the cylinder block 10. The intake passage 94 is connected to a solenoid-operated control valve 100 provided to control the pressure in the crank chamber 96. The solenoid-operated control valve 100 includes a solenoid coil 102, and a shut-off valve 104 which is selectively closed and opened by energization and de-energization of the solenoid coil 102. Namely, the shut-off valve 104 is placed in its closed state when the solenoid coil 102 is energized, and is placed in its open state when the coil 102 is de-energized.

The rotary drive shaft 50 has a bleeding passage 110 formed therethrough. The bleeding passage 110 is open at one of its opposite ends to the central support hole 56 indicated above, and is open to the crank chamber 96 through a communication passage 112. The central support hole 56 communicates at its bottom with the suction chamber 22 through a communication port 114.

When the solenoid coil 102 of the solenoid-operated control valve 100 is energized, the intake passage 94 is closed, so that the pressurized refrigerant gas in the discharge chamber 24 is not delivered into the crank chamber 96. In this condition, the refrigerant gas in the crank chamber 96 flows into the suction chamber 22 through the bleeding passage 110 and the communication port 114, so that the pressure in the crank chamber 96 is lowered. As a result, the angle of inclination of the swash plate 60 with respect to a plane perpendicular to the axis of rotation M of the drive shaft 50 is increased, and the discharge capacity of the compressor is accordingly increased.

When the solenoid coil 102 is de-energized, the intake passage 94 is opened, permitting the pressurized refrigerant gas to be delivered from the discharge chamber 24 into the crank chamber 96, resulting in an increase in the pressure in the crank chamber 96, and the angle of inclination of the swash plate 60 is reduced, so that the discharge capacity of the compressor is accordingly reduced.

The maximum angle of inclination of the swash plate 60 is limited by abutting contact of a stop 120 formed on the swash plate 60, with the lug plate 62, and the minimum angle of inclination of the swash plate 60 is limited by abutting contact of the swash plate 60 with a stop 122 in the form of a ring fixed to the drive shaft 50.

As described above, the pressure in the crank chamber 96 is controlled by controlling the solenoid-operated control valve 100 to selectively connect and disconnect the crank chamber 96 to and from the discharge chamber 24. The angle of inclination of the swash plate 60 is changed with a change in the pressure in the crank chamber 96, so that the stroke of the piston 14 is controlled to control the discharge capacity of the compressor. Thus, the swash plate type compressor having the piston 14 in each cylinder bore 12 is of a variable capacity type. The solenoid coil 102 of the solenoid-operated control valve 100 is controlled by a control device (not shown) depending upon a load acting on the air conditioning system including the present compressor. The control device is principally constituted by a computer.

The cylinder block 10 and each piston 14 are formed of an aluminum alloy. The piston 14 is coated at its outer circumferential surface with a fluoro resin film, which prevents a direct contact of the aluminum alloy of the piston 14 with the aluminum alloy of the cylinder block 10, and makes it possible to minimize the amount of clearance between the piston 14 and the cylinder bore 12. The cylinder block 10 and the piston 14 may also be formed of a hyper-eutectic aluminum silicon alloy. Other materials may be used for the cylinder block 10 and the piston 14.

There will next be described the configuration of the piston 14.

As shown in FIGS. 2–5, the head portion 82 of the piston 14 includes a body portion 128, and an outer sliding section 130 and an inner sliding section 132 which correspond to respective radially outer and inner portions of the cylinder block 10. The radially outer portion of the cylinder block 10 is more distant from the centerline M than the radially inner portion of the cylinder block 10. The body portion 128 has a circular shape in cross section. The outer and inner sliding sections 130, 132 project towards the neck portion 80 from respective circumferential parts of the circular body portion 128, which parts correspond to the radially outer and inner portions of the cylinder block 10. The outer and inner sliding sections 130, 132 are adapted to slide on the respective circumferential portions of the inner circumferential surface of the cylinder bore 12, which portions correspond to the radially outer and inner portions of the cylinder block 10. The connecting portion 83 of the piston 14 includes a rib 134 connecting the inner sliding section 132 and the neck portion 80, and a rib 135 connecting the outer sliding section 130 and the neck portion 80.

A wall 138 is formed so as to connect the ribs 134, 135 to each other, and connect the inner and outer sliding sections 132, 130 to each other. The wall 138 functions to increase the strength of the piston 14, for thereby reducing a local wear of the piston 14.

As shown in FIGS. 3, 3A, 3B and 4, a recess 144 and a recess 145 are formed on respective opposite sides of the wall 138, in an inner surface 140 of the inner sliding section 132 which faces towards the outer sliding section 130, and in an inner surface 142 of the body portion 128 which faces towards the neck portion 80 and which is contiguous with the inner surface 140. The inner surface 140 faces towards the centerline N of the piston 14 (faces in a direction intersecting the centerline N), but the inner surface 142 does not face towards the centerline N, namely, faces in a direction substantially parallel to the centerline N and extends towards the neck portion 80.

Figure 6:
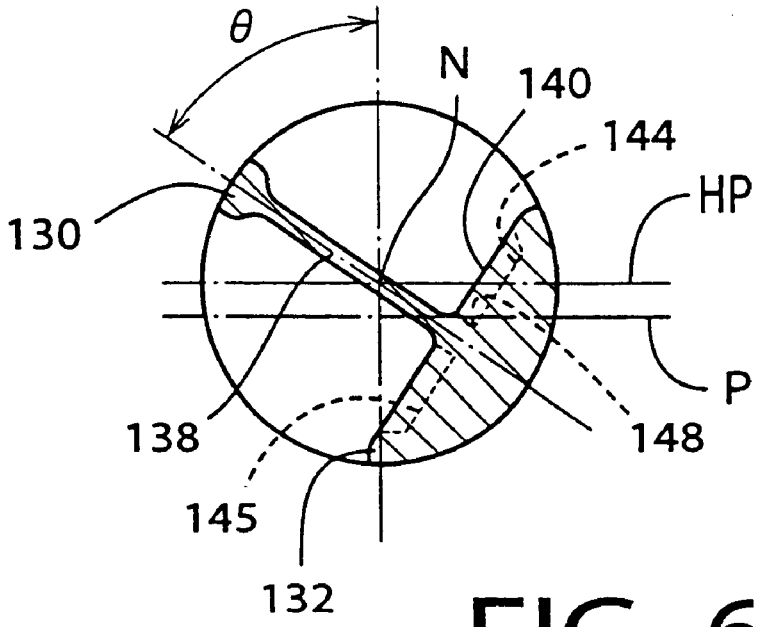
FIG. 6 is a view in transverse cross section, for explaining that a lubricant oil can be accommodated in the recesses.

The recesses 144, 145 are configured so that a lubricant oil can be accommodated or accumulated in the recesses 144, 145 if the piston 14 is fitted in any one of the cylinder bores 12, which is located at a relatively high or upper position in the cylinder block. Described in detail by reference to FIGS. 3, 3A and 3B, a lowest point 148 on the bottom surface of each recess 144, 145 is lower than an imaginary horizontal plane P which is an extension of the inner surface 140 towards the body portion 128. Namely, the entire peripheral edge of the recess 144, 145 is located closer to the centerline N than the lowest point 148 of the recess 144, 145, that is, located above the lowest point 148, so that the lubricant oil can be accommodated in a lower portion of each recess 144, 145 when the piston 14 has a posture of FIG. 3. The lubricant oil can be accommodated in the recesses 144, 145 even when the piston 14 is in a position rotated about its centerline N through an angle θ within a certain range, from the position of FIG. 3. For instance, the recess 144 has a portion that can accommodate the lubricant oil even when the wall 138 is inclined at an angle θ with respect to the vertical plane, as indicated in FIG. 6, as a result of rotation of the piston 14. In this posture of the piston 14, the above-indicated portion of the recess 144 is located below the imaginary plane P parallel to the horizontal plane HP which includes the centerline N.

Figure 3:
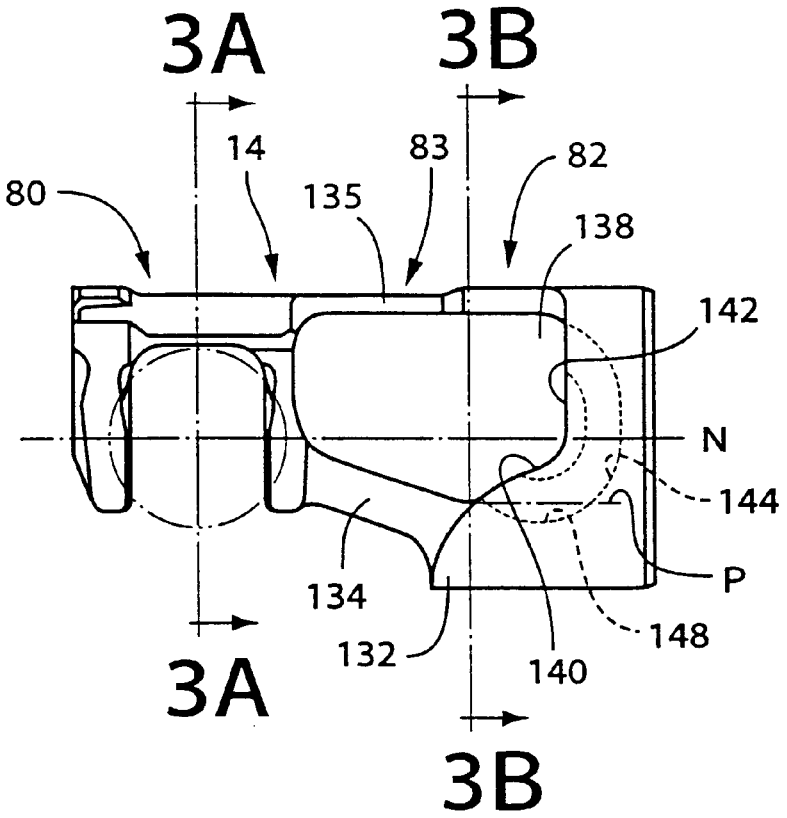
FIG. 3 is a side elevational view of the piston of FIG. 1.
Figure 3A:
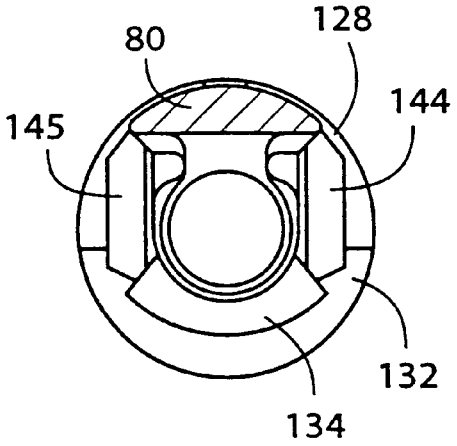
FIG. 3A is a cross sectional view taken along line 3A—3A of FIG. 3.
Figure 3B:
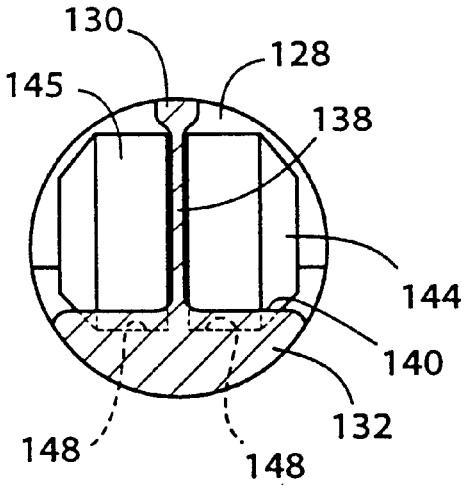
FIG. 3B is a cross sectional view taken along line 3B—3B of FIG. 3.
Figure 4:
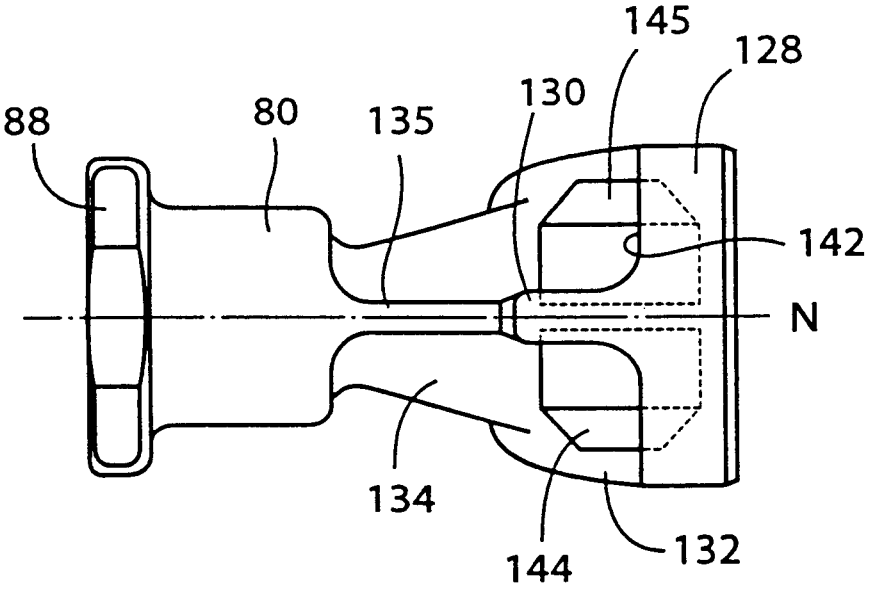
FIG. 4 is a plan view of the piston of FIG. 1.
Figure 5:
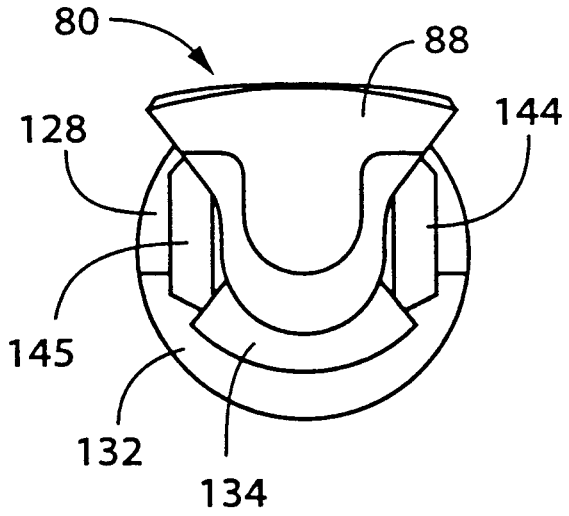
FIG. 5 is a front elevational view of the piston of FIG. 1.

The upper limit of the angle of rotation of the piston 14 which permits an appreciable amount of the lubricant oil to be accommodated in the recesses 144, 145 is determined by the configuration of the recesses 144, 145. If the angle of rotation of the piston 14 from the angular position of FIG. 3 is not larger than the upper limit when the piston 14 is fitted in the corresponding cylinder bore 12, the lubricant oil can be accommodated in the recess 144, 145. The positions and the number of the pistons 14 in which the lubricant oil can be accommodated in at least one of the recesses 144, 145 are determined by the configuration of the recesses 144, 145, and the number of the cylinder bores 12 which determines the angular interval of the cylinder bores 12.

Although the portion of each recess 144, 145 which is formed in the inner surface 142 of the body portion 128 does not accommodate the lubricant oil, this portion contributes to a reduction in the weight of the piston 14.

Figure 7:
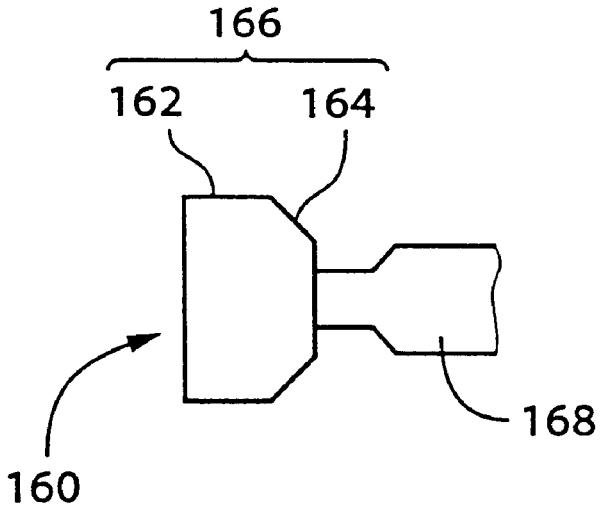
FIG. 7 is a schematic view showing an outer profile of a cutting tool used to form the recesses in the piston of FIG. 1.
Figure 8:
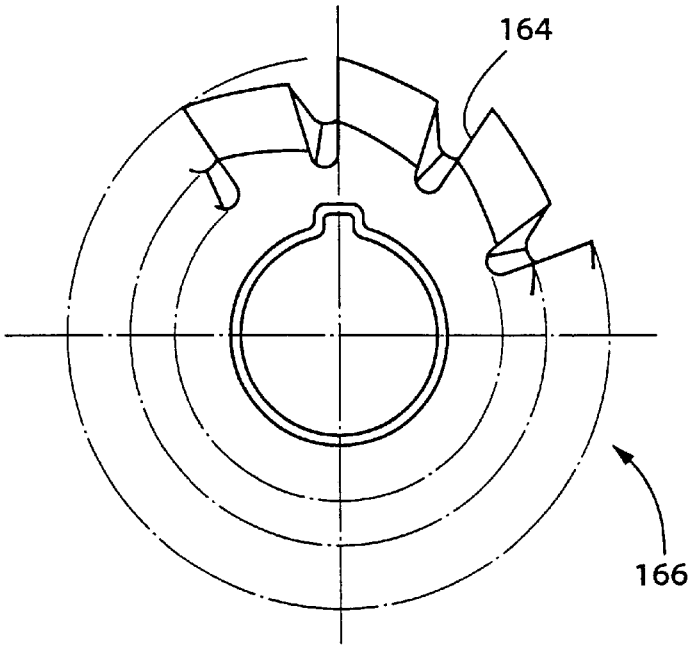
FIG. 8 is a flow elevational view of the cutting tool.
Figure 9:
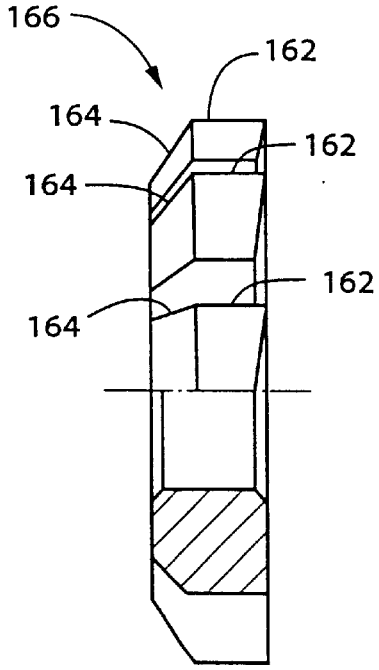
FIG. 9 is a side elevational view partly in cross section of the cutting tool.

The recesses 144, 145 are formed by a cutting tool 160 generally shown in FIG. 7 and specifically shown in FIGS. 8 and 9. The cutting tool 160 consists of a body 166 serving as a cutting portion, and a shank 168 serving as a drive shaft. The body 166 has a primary cutting edge in the form of a peripheral cutting edge 162, and an auxiliary cutting edge in the form of a side cutting edge 164. For example, the cutting tool 160 is a formed side milling cutter capable of forming a groove having a straight bottom surface and tapered side surfaces.

Figure 10:
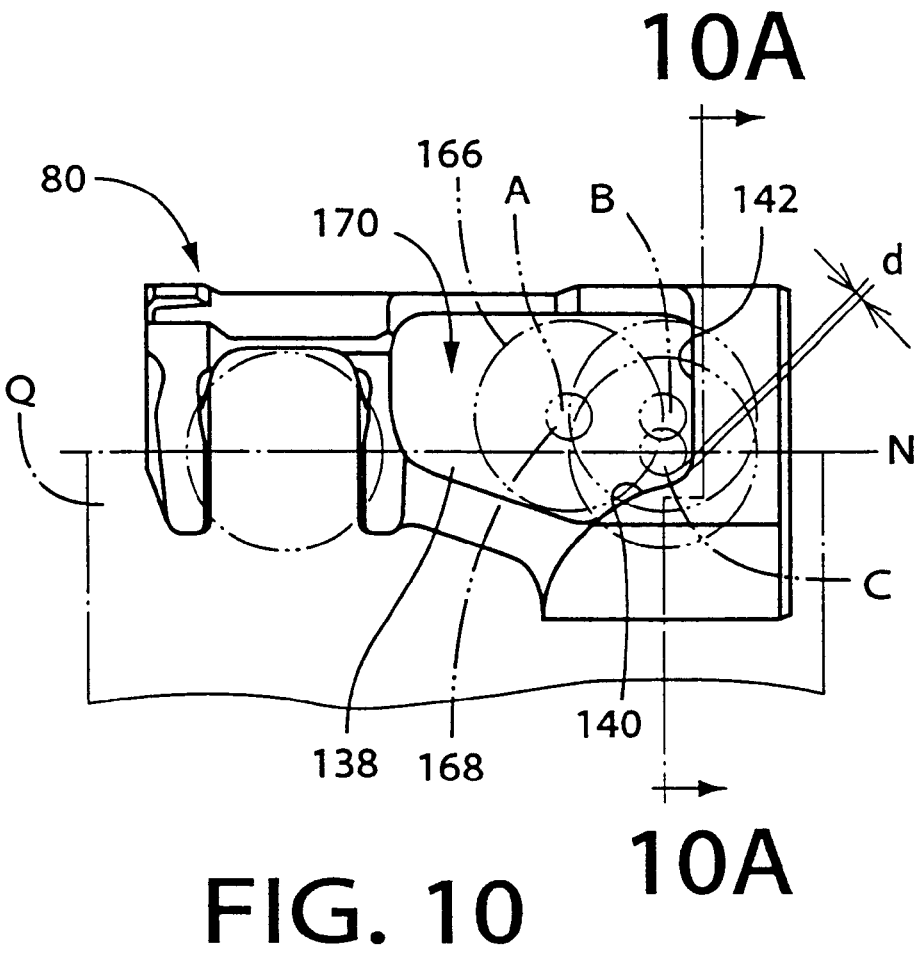
FIG. 10 is a view indicating a path of movement of the cutting tool.

When each recess 144, 145 is formed by the cutting tool 160, the tool 160 is held at its shank 168 in a spindle of a milling or drilling machine, and is positioned such that the axis of rotation of the tool 160 is perpendicular to a center plane Q which includes the centerline N of the piston 14 (indicated in FIGS. 10 and 10A) and the centerline M of the cylinder block 10 (indicated in FIG. 1). The cutting tool 160 is rotated and is inserted into an opening 170, as indicated in FIG. 10. The opening 170 is defined by the neck portion 80, the connecting portion 83, the head portion 128 (outer and inner sliding sections 130, 132 and body portion 128), and the wall 138, as indicated in FIG. 10. Then, the cutting tool 160 and the piston 14 are fed relative to each other along a predetermined path passing points A, B and C, which path is parallel to the center plane Q of the piston 14.

If necessary, the cutting tool 160 and the piston 14 are fed relative to each other in the direction perpendicular to the center plane Q. Namely, if the axial dimension of the body 166 of the cutting tool 160 is smaller than the width of the recess 144, 145 as measured in the direction perpendicular to the center plane Q, the tool 160 and the piston 14 are moved relative to each other in the above-indicated direction. In the present embodiment, the piston 14 is held stationary, and the cutting tool 160 is fed relative to the piston 14 to cut the recess 144, for example, such that the cross sectional profile of the recess 144 in a cross sectional plane parallel to the center plane Q is defined by an arc of a circle whose centerline is perpendicular to the center plane Q This circular arc extends from a first point on the circle at which the central angle θ with respect to a reference line which passes the center of the circle and which is parallel to the centerline N is not larger than 90°, to a second point on the circle at which the central angle θ with respect to the reference line is larger than 90°. The axis of the shank 168 when the tool 160 is located at point C is spaced from the inner surface 140 by a distance "d" indicated in FIG. 10.

Figure 18:
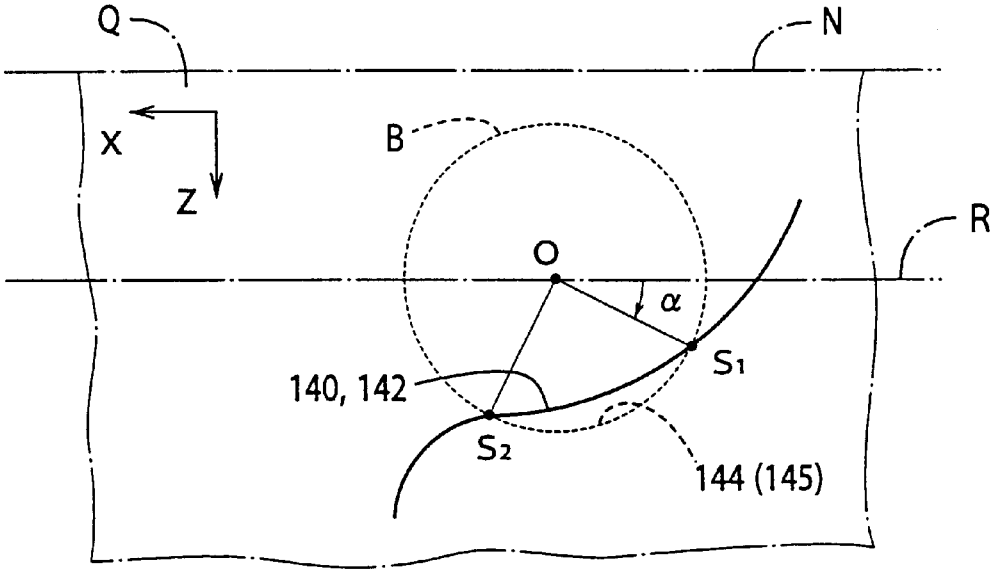
FIG. 18 is a view indicating a configuration of a recess formed in a piston according to an embodiment of the invention.
Figure 19:
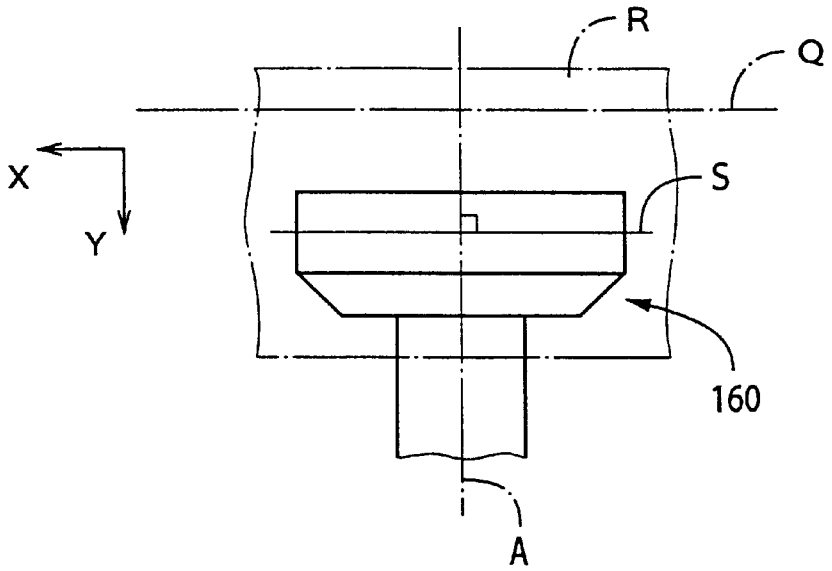
FIG. 19 is a view indicating a relative position of a cutting tool used to form the recess and a center plane Q in the embodiment of FIG. 18.

Referring to FIGS. 18 and 19, the cross sectional profile of the recess 144 will be described in detail, by way of example.

The center plane Q of the piston 14 which includes the centerline N of the piston 14 and the centerline M of the cylinder block 10 is parallel to an X-Z plane indicated in FIG. 18. In the X-Z plane, the cutting tool 160 is moved along the X and Z axes. The above-indicated cross sectional plane (indicated at S in FIG. 19), which is parallel to the center plane Q, is also parallel to the X-Z plane. A straight line A perpendicular to the cross sectional plane S is parallel to the axis of rotation of the cutting tool 160 (main spindle of the machine), and is parallel to the Y axis which is perpendicular to the center plane Q. The above-indicated circle, which is indicated at B in FIG. 19, has a center O on the straight line A. A reference plane R parallel to the centerline N (X axis) and perpendicular to the center plane Q passes the center O of the circle B, as indicated in FIG. 18. It will be understood that a straight segment extending between two points of intersection between the reference plane R and the circle B passes the center O and represents a diameter of the circle B. The right half of this straight segment as seen in FIG. 18 represents a central angle α of 0° at the right one of the above-indicated two points of intersection. As this right half is rotated about the center O in the clockwise direction, the central angle α is increased. The cross sectional profile of the recess 144 in the cross sectional plane S parallel to the center plane Q is defined by an arc of the circle B, which extends from a point S1 at which the central angle α is not larger than 90°, to a point S2 at which the central angle α is larger than 90°.

Figure 20:
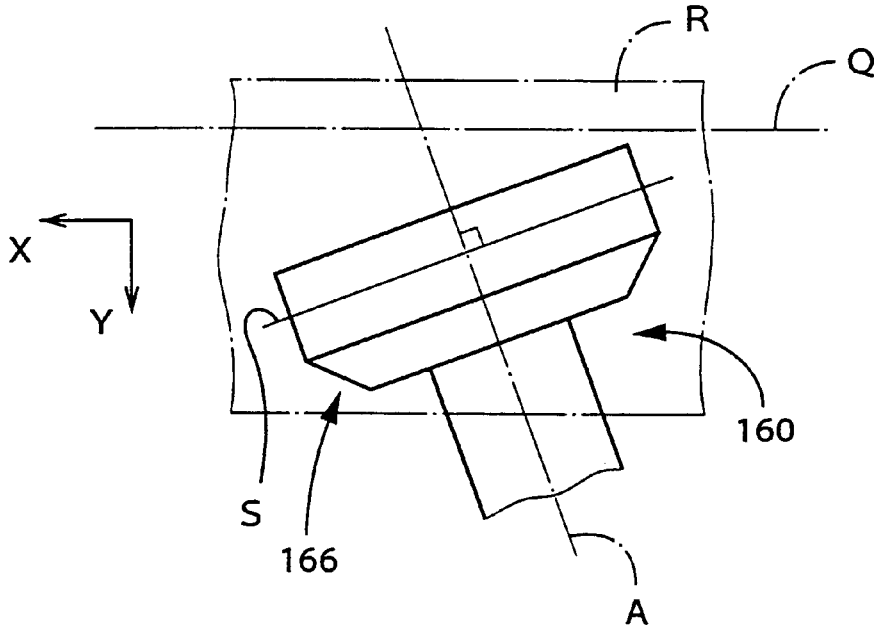
FIG. 20 is a view indicating another relative position between the cutting tool and the center plane Q.
Figure 21:
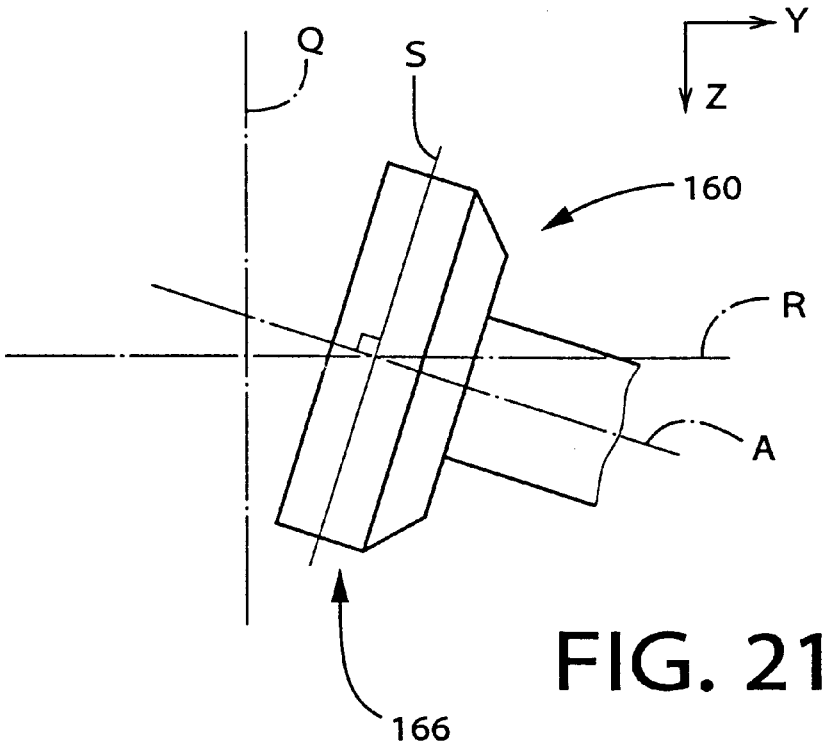
FIG. 21 is a view indicating a further relative position between the cutting tool and the center plane Q.

A recess may be formed by the cutting tool such that the axis of rotation of the cutting tool represented by the straight line A is held inclined with respect to the center plane Q, as shown in FIGS. 20 and 21, rather than held perpendicular to the center plane Q as shown in FIGS. 19 and 20. That is, the recess may be formed by feeding the cutting tool 160 and the piston 14 relative to each other in a direction parallel to the center plane Q, while the axis of rotation of the cutting tool 160 represented by the straight line A is held inclined with respect to the Y axis in the X-Y plane as shown in the plan view of FIG. 20, or with respect to the Y axis in the Y-Z plane as shown in the side elevational view of FIG. 21. It is required or desired that the axis of rotation of the cutting tool 160 be inclined with respect to the Y axis perpendicular to the center plane Q, in some cases, depending upon: the dimensions of the cutting tool 160 (in particular, dimensions of the body 166); the configuration of the recess 144 to be formed; the size of the opening 170 between the neck and head portions 80, 82; the configuration of the piston 14 (in particular, the configuration of the inner surface 140 in which the recess is formed); and the construction of the machine tool. In these cases, the cross sectional plane S perpendicular to the axis of rotation of the cutting tool (straight line A) is not parallel to the center plane Q, but the above-indicated reference plane R parallel to the X-Y plane intersects the circle B whose center O lies on the straight line A (axis of rotation of the cutting tool). The point of intersection between the circle B and the reference plane R represents the central angle 0°, and the cross sectional profile is represented by an arc of the circle B, which extends from a point S1 at which the central angle α is not larger than 90°, to a point S2 at which the central angle α is larger than 90°.

The recess 145 on the other side of the wall 138 can be formed by a relative movement of the cutting tool 160 and the piston 14 along the predetermined cutting path through the opening 170 provided on the above-indicated other side of the wall 138.

In the present embodiment which has been described, the recesses 144, 145 capable of accommodating the lubricant oil are partially formed in the inner surface 140 of the inner sliding section 132 which faces in the radially outward direction of the cylinder block 10. Where the piston 14 is fitted in one of the cylinder bores 12 which is located at a relatively high position in the cylinder block 10, the slidability of the piston 14 is improved. Namely, the lubricant oil is sufficiently delivered to the contacting surfaces of the piston 14 and the cylinder bore 12 at the relatively high position, and to the contacting surfaces of the swash plate 60 and the piston 14 fitted in that cylinder bore 12, so that those contacting surfaces can be sufficiently lubricated, and the local wear of the piston 14 can be reduced, assuring a prolonged service life of the piston 14. Further, the recesses 144, 145 reduce the weight of the piston 14.

In the presence of the openings 170 provided between the outer and inner sliding sections 130, 132 of the head portion 82 of the piston 14, the recesses 144, 145 can be easily formed in the inner surface 140 of the head portion 82 which faces towards the centerline N or faces in a direction intersecting the centerline N.

While the two recesses 144, 145 are formed in the above embodiment, only one of the recesses 144, 145 may be formed. Although the recesses 144, 145 are configured to accommodate the lubricant oil where the piston 14 is located at a relatively high position in the cylinder block 10, they may be configured to accommodate the lubricant oil where the piston 14 is located at other positions. The principle of the present invention is applicable to the piston 14 which is fitted in any one of the cylinder bores 12 and which has at least one recess capable of accommodating the lubricant oil to improve the slidability of the piston 14.

Figure 11:
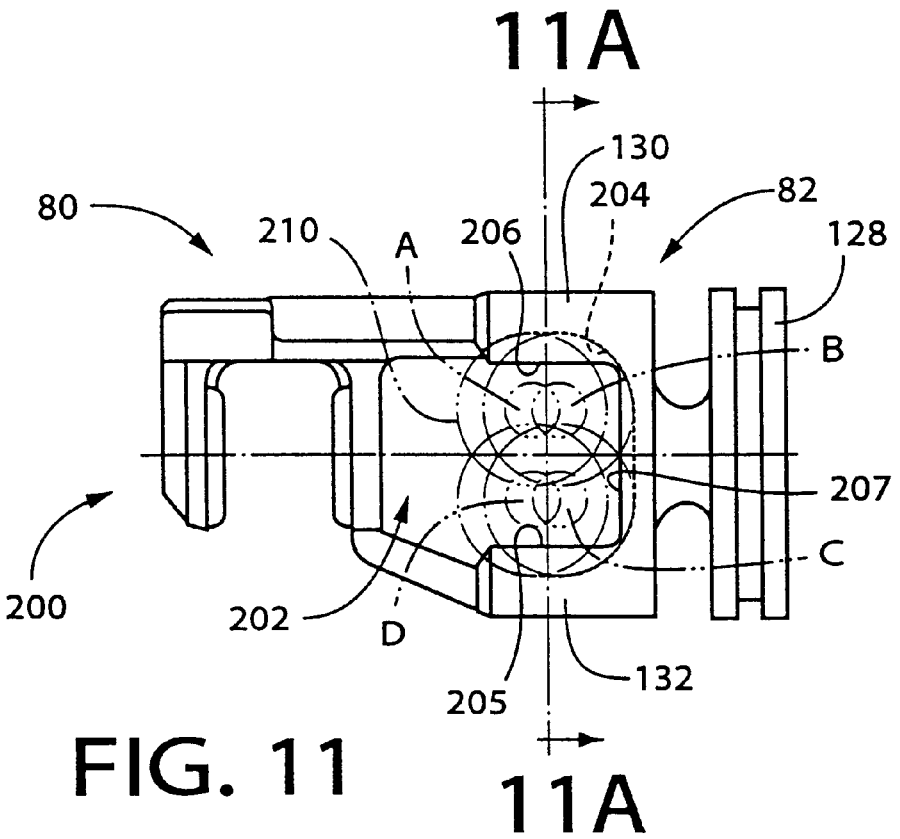
FIG. 11 is a side elevational view of a piston according to another embodiment of this invention.
Figure 11A:
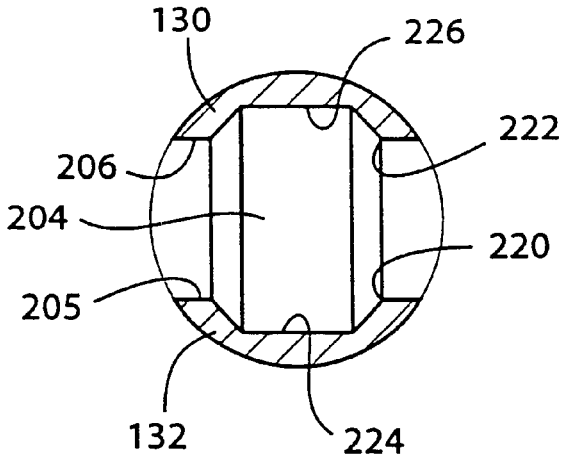
FIG. 11A is a cross sectional view taken along line 11A—11A of FIG. 11.

The configuration of the piston provided according to the present invention is not limited to that of the piston 14 according to the first embodiment. For instance, a piston 200 as shown in FIGS. 11 and 11A is provided according to a second embodiment of the invention.

Like the head portion 82 of the piston 14, the head portion 82 of the piston 200 includes the body portion 128 and the outer and inner sliding sections 130, 132, but the piston 200 does not include the wall 138, so that the piston 200 has a single opening 202 formed therethrough. Further, a recess 204 is formed in an inner surface 205 of the inner sliding section 132, an inner surface 206 of the outer sliding section 130, and an inner surface 207 of the body portion 128. The inner surfaces 205, 206 face towards the centerline N (faces in directions intersecting the centerline N), while the inner surface 207 faces towards the neck portion 80.

Figure 12:
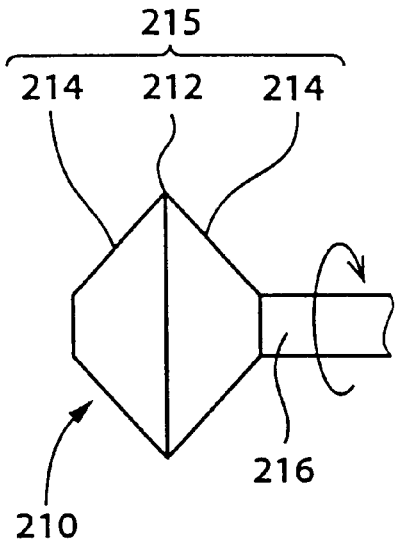
FIG. 12 is a schematic view showing an outer profile of a cutting tool used to form a recess in the piston of FIG. 11.

To form the recess 204 in the present second embodiment, a cutting tool 210 shown in FIG. 12 is used. The cutting tool 210 consists of a body 215 having cutting edges 214, and a shank 216. The cutting edges 214 are shaped to form a V-shaped groove if the cutting tool 210 is moved in the direction parallel to the center plane Q. The cutting edges 214 have a central ridge 212 at which the body 215 has the largest diameter and which corresponds to the bottom of the V-shaped groove. To form the recess 204, the cutting tool 210 and the piston 200 are fed relative to each other along a predetermined path passing points A, B, C and D as indicated in FIG. 11, in the direction parallel to the center plane Q, while the cutting edges 214 are held in contact with at least one of the inner surfaces 205, 206, 207 at one time. In the present embodiment wherein the cutting tool 210 has the ridge 212, the cutting tool 210 and the piston 200 are fed relative to each other also in the direction perpendicular to the center plane Q, so that the central ridge 212 is fed by a distance equal to the width of the recess 204 as measured in the axial direction of the cutting tool 210.

Figure 10A:
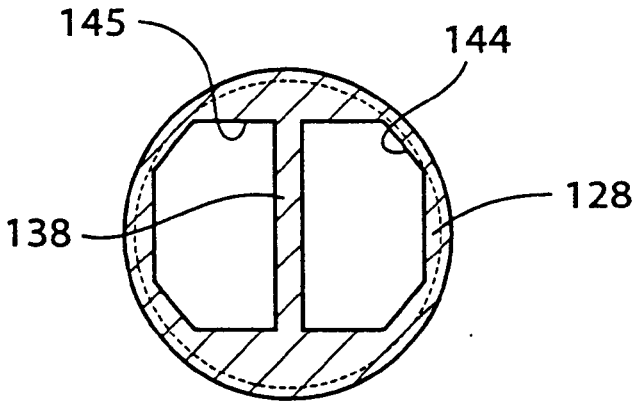
FIG. 10A is a cross sectional view taken along line 10A—10A of FIG. 10.

In the present second embodiment wherein the opening 202 is formed through the piston 200, the cutting tool 215 and the piston 200 can be fed relative to each other, without a risk of interference with the wall 138, in the direction perpendicular to the center plane Q. That is, the body 215 of the tool 210 can be advanced past the centerline N in one direction perpendicular to the center plane Q, in a single feeding motion. In the first embodiment, the cutting tool 160 is fed in the opposite directions perpendicular to the center plane Q, in two feeding motions, to form the respective two recesses 144, 145 on the respective opposite sides of the wall 138 (FIGS. 10 and 10A). In this sense, the recess 204 can be formed by the cutting tool 210 with higher efficiency.

As shown in FIGS. 11 and 11A, the recess 204 is formed in the inner surfaces 205, 206 and 207. The recess 204 has an edge 220 on the inner surface 205 of the inner sliding section 132 which faces in the direction intersecting the centerline N, and an edge 222 on the inner surface 206 of the outer sliding section 130 which faces in the direction intersecting the centerline N. These edges 220, 222 are closer to the centerline N than bottom surfaces 224, 226 of the recess 204, namely, located above the bottom surfaces 224, 226, so that the lubricant oil can be accommodated in not only the portion of the recess 204 which corresponds to the inner sliding section 132, but also the portion of the recess 204 in the outer sliding section 130. That is, the lubricant oil can be accommodated in the recess 204 when the piston 200 is fitted in the cylinder bore 12 located at a relatively low position in the cylinder block 10, as well as when the piston 200 is fitted in the cylinder bore 12 located at a relatively high position. Accordingly, the number of the pistons 200 whose slidability is improved is increased.

Figure 13:
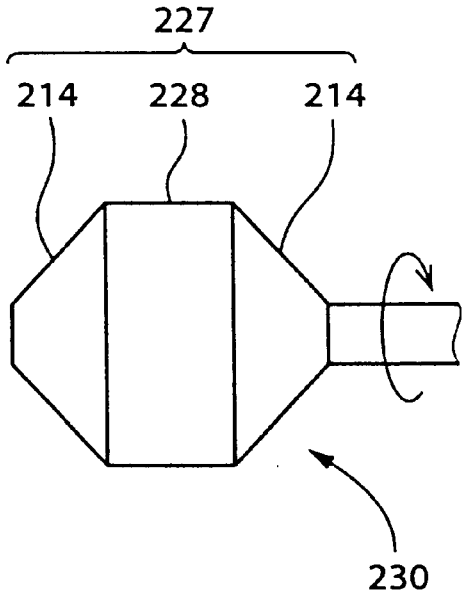
FIG. 13 is a schematic view showing an outer profile of another cutting tool used to form a recess in a piston according to a further embodiment of the invention.

While the cutting tool 210 having the ridge 212 used in the second embodiment is moved in its axial direction perpendicular to the center plane Q, the recess 204 can be formed without a movement or with a relatively small movement of a cutting tool in the axial direction in the third embodiment of this invention. The cutting tool 230 has a body 227 consisting of a peripheral cutting edge 228 and two side cutting edges 214, as shown in FIG. 13. If the axial dimension of the peripheral cutting edge 228 is substantially equal to the width of the groove 204, the cutting tool 230 and the piston 200 need not be fed relative to each other in the direction perpendicular to the center plane Q (FIG. 10). It is also noted that the side cutting edges 214 are not essential, provided the body of the cutting tool has the peripheral cutting edge 228.

Figure 14:
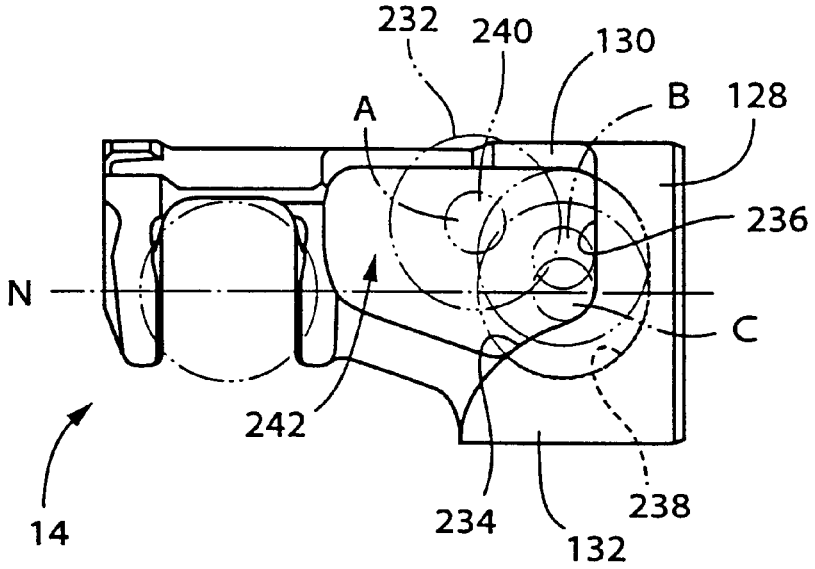
FIG. 14 is a view indicating a path of movement of a cutting tool in a yet further embodiment of the invention.
Figure 15:
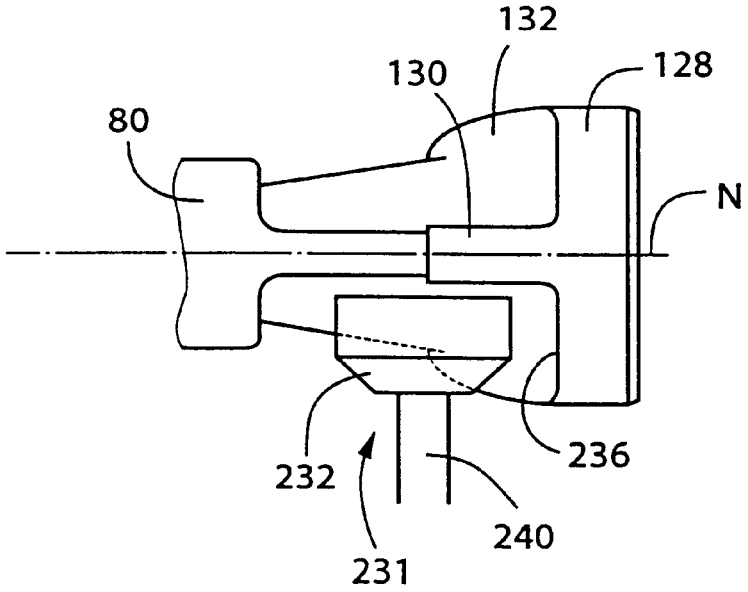
FIG. 15 is a view indicating a relative position of the cutting tool and the piston when the recess is formed in the embodiment of FIG. 14.

In a fourth embodiment of the invention shown in FIGS. 14 and 15, a recess 238 is formed in an inner surface 234 of the inner sliding section 132 which faces towards the centerline N (in a direction intersecting the centerline N), and an inner surface 236 of the body portion 128 which faces towards the neck portion 80. In this embodiment wherein the cutting tool has a body 232 and a shank 240, the recess 238 is formed by a relative movement of the tool and the piston 14 in the direction parallel to the center plane Q, along a predetermined path which passes points A, B and C as indicated in FIG. 14, such that the body 232 is partially located outside an opening 242 formed in the piston 14.

The configuration and dimensions of the recess to be formed in the piston are suitably determined, but the size of the recess is desirably maximized to minimize the weight of the piston, to such an extent that assures the required strength of the piston at its inner and outer sliding sections 132, 130. At least one of the inner and outer sliding sections 132, 130 may have at least one through-hole formed therethrough in the radial direction of the piston. The through-hole permits a smooth supply of the lubricant oil from the piston to the cylinder bore 12. The through-hole may be formed independently of the recess, or alternatively formed in communication with the recess.

Although the recesses 144, 145, 204, 238 are formed by a relative movement of the cutting tool and the piston while the axis of rotation of the cutting tool is held perpendicular to the center plane Q, the recesses may be formed by the relative movement while the axis of rotation of the cutting tool is held inclined relative to the center plane Q, as shown in FIGS. 20 and 21. The cutting tool is not limited to a formed side milling cutter, but may be a drill or an end mill. The configuration of the piston having the recess is not limited to the details of the preceding embodiments. For instance, the connecting portion may consist of an inner connecting part connecting the inner sliding section 132 and the neck portion 80, without an outer connecting part connecting the outer sliding section 130 and the neck portion 80. Examples of this modification are shown in FIGS. 16, 16A, 17 and 17A as fifth and sixth embodiments.

Figure 16:
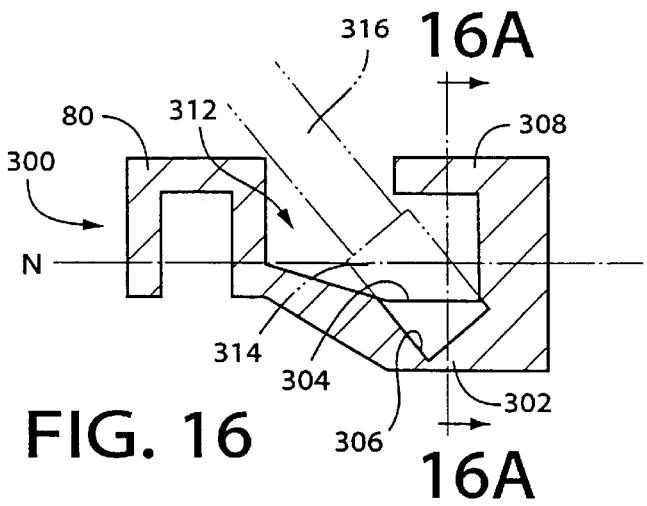
FIG. 16 is a cross sectional view of a piston according to a still further embodiment of the invention.
Figure 16A:
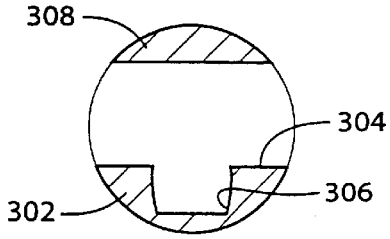
FIG. 16A is a cross sectional view taken along 16A—16A of FIG. 16.

In a piston 300 of FIG. 16, an inner sliding section 302 has a recess 306 in an inner surface 304 thereof which faces towards the centerline N. In the absence of an outer connecting part connecting an outer sliding section 308 and the neck portion 80, there is provided an opening 312 between the outer sliding projection 308 and the neck portion 80. The inner surface 304 can be easily accessed through the opening 312 when the recess 306 is formed in the inner surface 304.

In the present fifth embodiment, the recess 306 is formed by an end mill 314 having a shank 316, while the shank 316 extends through the opening 312. Namely, the rotating end mill 314 extending through the opening 316 and the piston 14 are fed relative to each other, with the cutting edge of the end mill 314 being held in contact with the inner surface 304. The recess 306 is configured to be able to accommodate the lubricant oil, when the piston 300 is located at a relatively high position in the cylinder block 10.

The piston 300 may be produced by casting with the recess 306 formed in the inner surface 304. A slide core used for forming the recess 306 during casting of the piston 300 can be easily set in a casting mold, through an opening of the mold corresponding to the opening 312.

Figure 17:
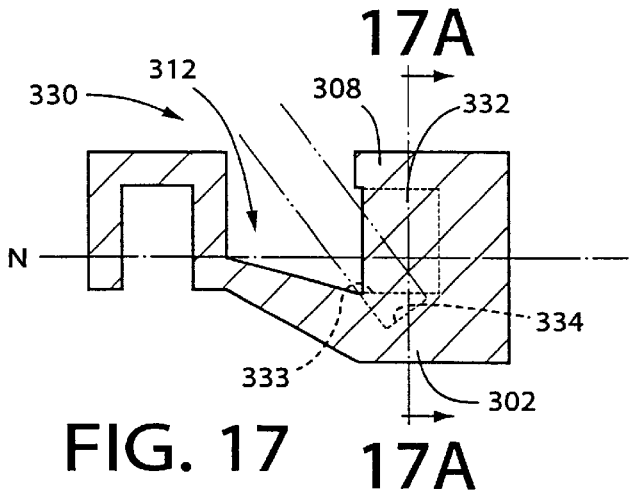
FIG. 17 is a cross sectional view of a piston according to still another embodiment of the invention.
Figure 17A:
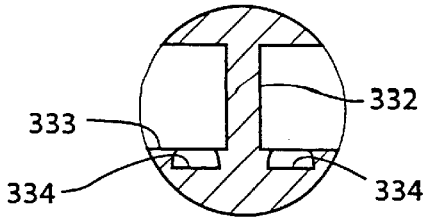
FIG. 17A is a cross sectional view taken along line 17A—17A of FIG. 17.

In a piston 330 of FIG. 17 according to the sixth embodiment, there is provided a wall 332 extending in the radial direction of the cylinder block 10, as in the first embodiment. The piston 330 have two openings 312 on the opposite sides of the wall 332. In an inner surface 333 of an inner sliding section 302 which faces towards an outer sliding section 308, there are formed two recesses 334 on the respective opposite sides of the wall 332, by a drill extending through the openings 312, The recesses 334 are also configured so as to accommodate the lubricant oil.

Figure 22:
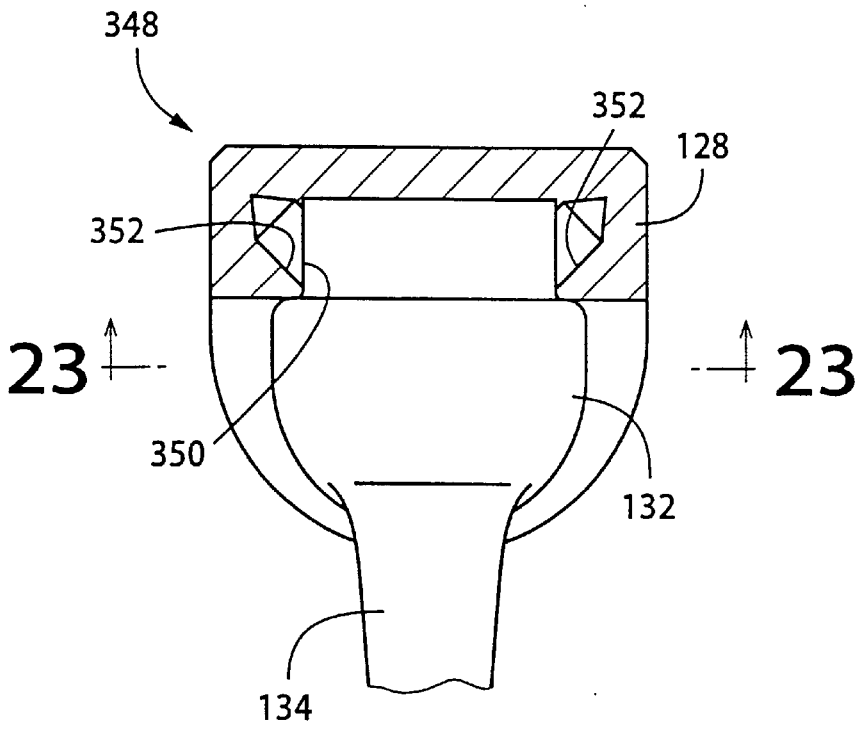
FIG. 22 is a sectional view taken along line 22—22 of FIG. 23, showing a yet further embodiment of this invention.
Figure 23:
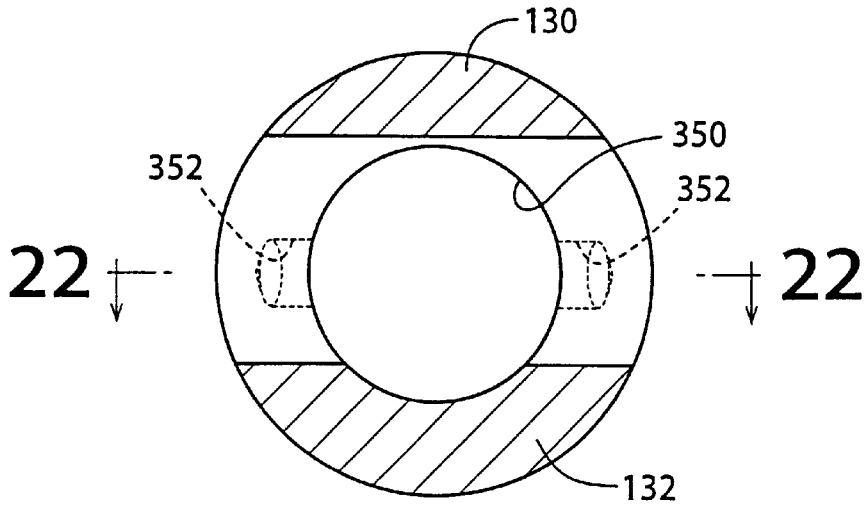
FIG. 23 is a cross sectional view taken along line 23—23 of FIG. 22.

Referring to FIGS. 22 and 23, there is shown a further embodiment of this invention, wherein a piston 348 has two recesses 252 formed in an inner circumferential surface of the body portion 128 of the head portion. Described more specifically, the head portion 128 is formed by die-casting with a circular hole 350 having a centerline aligned with the centerline N of the pistion 348. The two recesses 352 are formed by an end mill, in respective two circumferential portions of the circumferential surface of the circular hole 350, which portions are opposed to each other in the diametric direction of the hole 350 which is parallel to the vertical direction, so that a lubricant can be accommodated in one of these two recesses 352 where the piston 348 is located at a relatively high or low position in the compressor.

The construction of the swash plate type compressor for which the piston 14, 200, 300, 330 is incorporated is not limited to that of FIG. 1. For example, the solenoid-operated control valve 100 is not essential, and the compressor may use a shut-off valve which is opened and closed on the basis of a difference between the pressures in the crank chamber 96 and the suction chamber 24. The control valve 100 or the shut-off valve permits an increase in the discharge capacity of the compressor with a decrease in the pressure in the crank chamber 96 and a consequent increase in the angle of inclination of the swash plate 60.

It is to be understood that the present invention is not limited to the details of the illustrated embodiments and the various forms of the invention described in the SUMMARY OF THE INVENTION, but may be otherwise embodied.

What is claimed is:

1. A piston for a swash plate type compressor, including a head portion slidably fitted in a cylinder bore formed in a cylinder block of the compressor, a neck portion slidably engaging a swash plate of the compressor, and a connecting portion connecting said head and neck portions, wherein an improvement comprises:

said head portion having an inner surface which faces towards a centerline of the piston and which has at least one recess formed therein, said inner surface being located and said at least one recess being configured such that said at least one recess can accommodate a liquid when the piston is fitted in said cylinder bore.

2. A piston according to claim 1, wherein said head portion includes a body portion having a circular shape in cross section, and an outer sliding section and an inner sliding section which extend towards said neck portion from respective circumferential parts of said body portion which correspond to respective radially outer and inner portions of said cylinder block, said outer and inner sliding sections having respective sliding surfaces for sliding contact with respective circumferential portions of an inner circumferential surface of said cylinder bore, at least one of said outer and inner sliding sections having at least one through-hole formed therethrough in a radial direction of the piston.

3. A piston according to claim 1, wherein said connecting portion includes at least one of an inner connecting part connecting said head and neck portions on a radially inner side of said cylinder block, and an outer connecting part connecting said head and neck portions on a radially outer side of said cylinder block.

4. A piston according to claim 1, wherein said head portion includes (a) a body portion having a circular shape in cross section, (b) an outer sliding section and an inner sliding section which extend towards said neck portion from respective circumferential parts of said body portion which correspond to respective radially outer and inner portions of said cylinder block, said outer and inner sliding sections having respective sliding surfaces for sliding contact with respective circumferential portions of an inner circumferential surface of said cylinder bore, and (c) a wall connecting said outer and inner sliding sections.

5. A piston for a swash plate type compressor, including a head portion slidably fitted in a cylinder bore formed in a cylinder block of the compressor, a neck portion slidably engaging a swash plate of the compressor, and a connecting portion connecting said head and neck portions, wherein an improvement comprises:

said head portion having an inner surface which faces towards a centerline of the piston and which has at least one recess formed therein, each of said at least one recess having a cross sectional profile in a cross sectional plane substantially parallel to a center plane which includes said centerline of said piston and a centerline of said cylinder block, said cross sectional profile including an arc of a circle whose center lies on a straight line perpendicular to said cross sectional plane, said arc extending from a first point on said circle at which a central angle is not larger than 90° to a second point on said circle at which said central angle is larger than 90°, said central angle being measured with respect to a reference plane which includes said center of said circle and which is parallel to said centerline of said piston and perpendicular to said center plane.

6. A piston according to claim 5, wherein said head portion includes a body portion having a circular shape in cross section, and an outer sliding section and an inner sliding section which extend towards said neck portion from respective circumferential parts of said body portion which correspond to respective radially outer and inner portions of said cylinder block, said outer and inner sliding sections having respective sliding surfaces for sliding contact with respective circumferential portions of an inner circumferential surface of said cylinder bore, at least one of said outer and inner sliding sections having at least one through-hole formed therethrough in a radial direction of the piston.

7. A piston according to claim 5, wherein said connecting portion includes at least one of an inner connecting part connecting said head and neck portions on a radially inner side of said cylinder block, and an outer connecting part connecting said head and neck portions on a radially outer side of said cylinder block.

8. A piston according to claim 5, wherein said head portion includes (a) a body portion having a circular shape in cross section, (b) an outer sliding section and an inner sliding section which extend towards said neck portion from respective circumferential parts of said body portion which correspond to respective radially outer and inner portions of said cylinder block, said outer and inner sliding sections having respective sliding surfaces for sliding contact with respective circumferential portions of an inner circumferential surface of said cylinder bore, and (c) a wall connecting said outer and inner sliding sections.

9. A piston for a swash plate type compressor, including a head portion slidably fitted in a cylinder bore formed in a cylinder block of the compressor, a neck portion slidably engaging a swash plate of the compressor, and a connecting portion connecting said head and neck portions, wherein an improvement comprises:

said head portion including a body portion which is circular in cross section, and an outer sliding section and an inner sliding section which extend towards said neck portion from respective circumferential parts of said body portion which correspond to respective radially outer and inner portions of said cylinder block, said outer and inner sliding sections having respective sliding surfaces for sliding contact with respective circumferential portions of an inner circumferential surface of said cylinder bore;

said outer sliding section having a first inner surface which faces towards said inner sliding section, said inner sliding section having a second inner surface which faces towards said outer sliding section, said body portion having a circular hole formed in an inner surface which faces towards said neck portion, said circular hole having a centerline aligned with said centerline of the piston; and at least one of said first and second inner surface s a n d an inner circumferential surface of said circular hole having at least one recess which is configured so as to accommodate a liquid when the piston is fitted in said cylinder bore.

10. A piston according to claim 9, wherein said head portion includes a body portion having a circular shape in cross section, and an outer sliding section and an inner sliding section which extend towards said neck portion from respective circumferential parts of said body portion which correspond to respective radially outer and inner portions of said cylinder block, said outer and inner sliding sections having respective sliding surfaces for sliding contact with respective circumferential portions of an inner circumferential surface of said cylinder bore, at least one of said outer and inner sliding sections having at least one through-hole formed therethrough in a radial direction of the piston.

11. A piston according to claim 9, wherein said connecting portion includes at least one of an inner connecting part connecting said head and neck portions on a radially inner side of said cylinder block, and an outer connecting part connecting said head and neck portions on a radially outer side of said cylinder block.

12. A piston according to claim 9, wherein said head portion includes (a) a body portion having a circular shape in cross section, (b) an outer sliding section and an inner sliding section which extend towards said neck portion from respective circumferential parts of said body portion which correspond to respective radially outer and inner portions of said cylinder block, said outer and inner sliding sections having respective sliding surfaces for siding contact with respective circumferential portions of an inner circumferential surface of said cylinder bore, and (c) a wall connecting said outer and inner sliding sections.

13. A piston for a swash plate type compressor including a cylinder block having a horizontally extending centerline and a plurality of cylinder bores formed along a circle whose center lies on said horizontally extending centerline, said piston being reciprocably received in one of said plurality of cylinder bores and comprising:

a head portion slidably fitted in said one of said plurality of cylinder bores;

a neck portion slidably engaging a swash plate of said compressor; and a connecting portion connecting said head and neck portions to each other, and wherein said head portion has an inner surface which is substantially parallel to a horizontal plane including said centerline of said piston and which faces upwards, said inner surface having at least one recess each of which has a bottom located below an entire peripheral edge thereof as seen in a vertical direction.

14. A swash plate type compressor comprising:

a cylinder block having a horizontally extending centerline and a plurality of cylinder bores arranged along a circle whose center lies on said centerline;

a rotary drive shaft having an axis aligned with said centerline of said circle;

a swash plate rotated by said drive shaft; and a plurality of single-headed pistons each of which includes a head portion slidably fitted in a corresponding one of said plurality of cylinder bores, and a neck portion slidably engaging said swash plate, said piston being reciprocated by rotation of said swash plate by said drive shaft, and wherein said head portion of at least one of said plurality of pistons has an inner surface which faces generally upwards in a direction towards a centerline of said piston, said inner surface having at least one recess which is configured so as to accommodate a liquid.

15. A method of forming a t least one recess in an inner surface of a head portion of a piston for a swash plate type compressor including a cylinder block having a cylinder bore in which said piston is slidably received, said piston including (a) a neck portion slidably engaging a swash plate of the compressor, (b) said piston including a body portion having a circular shape in cross section, and an outer sliding section and an inner sliding section which extend towards said neck portion from respective circumferential parts of said body portion which correspond to respective radially outer and inner portions of said cylinder block, said outer and inner sliding sections having respective sliding surfaces for sliding contact with respective circumferential portions of an inner circumferential surface of said cylinder bore, and (c) a connecting portion connecting said head and neck portions to each other, said inner surface facing towards a centerline of said piston, said method comprising the steps of:

preparing a cutting tool including a shank, and a cutting portion which has a larger diameter than said shank and which is fixed to one end of said shank, said cutting portion having a peripheral cutting edge; and moving said cutting portion of said cutting tool and said piston relative to each other, within an opening provided between said outer and inner sliding sections, in directions substantially parallel to a center plane including a centerline of said cylinder block and said centerline of said piston, while an axis of rotation of said cutting tool is held substantially perpendicular to said center plane, so that said at least one recess is formed in said inner surface of said head portion, by at least said peripheral cutting edge.

16. A compressor piston comprising a cylindrical head portion, an opposite neck portion spaced away from said head portion, and a connecting portion extending between said head portion and said neck portion, said head portion having an inner surface facing towards a centerline of said piston, said inner surface having an oil accommodating recess formed therein.

* * * * *

UNITED STATES PATENT AND TRADEMARK OFFICE

CERTIFICATE OF CORRECTION

PATENT NO. : 6,324,960 B1
DATED : December 4, 2001
INVENTOR(S) : Fuminobu Enokijima et al.

It is certified that error appears in the above-identified patent and that said Letters Patent is hereby corrected as shown below:

Column 3,
Line 27, please delete "bore. in" and insert therefor -- bore in --;

Column 13,
Line 55, please delete "Q This" and insert therefor -- Q. This --;
Lines 56 and 59, please delete "θ" and insert therefor -- α --;

Column 19,
Line 65, please delete "surface s a n d" and insert therefor -- surfaces and --;

Column 20,
Line 27, please delete "siding" and insert therefor -- sliding --

Signed and Sealed this

Twenty-first Day of May, 2002

*Attest:*

*Attesting Officer*

JAMES E. ROGAN
*Director of the United States Patent and Trademark Office*